United States Patent [19]

Sweers

[11] Patent Number: 4,941,299

[45] Date of Patent: Jul. 17, 1990

[54] GUARD SCREEN FOR A RAIN GUTTER

[76] Inventor: Ronald L. Sweers, 6165 E. Atherton Rd., Burton, Mich. 48519

[21] Appl. No.: 324,801

[22] Filed: Mar. 17, 1989

[51] Int. Cl.[5] ..... E04F 13/06

[52] U.S. Cl. ..... 52/12

[58] Field of Search ..... 52/12; 210/474

[56] References Cited

U.S. PATENT DOCUMENTS

| | | | |
|---|---|---|---|
| 2,175,138 | 10/1939 | Westlake | 52/12 |
| 2,365,845 | 12/1944 | Schweda | 52/12 |
| 2,583,422 | 1/1952 | Haddon | 52/12 |
| 2,805,632 | 9/1957 | Couture | 52/12 |
| 2,935,954 | 5/1960 | Matthews | 52/12 |
| 2,948,083 | 8/1960 | Steele | 52/12 |
| 3,297,285 | 1/1967 | Simmons . | |
| 3,351,206 | 11/1967 | Wennerstrom . | |
| 3,420,378 | 1/1969 | Turner . | |
| 3,428,183 | 2/1969 | Bristow . | |
| 3,630,383 | 12/1971 | Reeves . | |
| 3,741,398 | 6/1973 | Abramson . | |
| 3,977,135 | 8/1976 | Hunley, Jr. . | |
| 4,036,761 | 7/1977 | Rankin . | |
| 4,307,976 | 12/1981 | Butler . | |
| 4,553,356 | 11/1985 | Pepper . | |
| 4,573,290 | 3/1986 | Fleming . | |
| 4,745,710 | 5/1988 | Davis | 52/12 |

FOREIGN PATENT DOCUMENTS

| | | | |
|---|---|---|---|
| 18587 | of 1889 | United Kingdom | 52/12 |

*Primary Examiner*—John E. Murtagh

*Attorney, Agent, or Firm*—Gifford, Groh, Sprinkle, Patmore and Anderson

[57] ABSTRACT

A guard screen for a rain gutter is provided for placement over the rain gutters of a building structure. The guard screen includes a longitudinal screen body portion bordered by a pair of longitudinal edges. The first edge has a channel defined therein for interconnection with the front lip of a gutter. The second edge includes a flange and a roof board edge abutment rib. The flange of the second edge fits between shingles of a roof and the roof boards. The roof board edge abutment rib abuts the roof board edge. Because the screen body portion is composed of a resilient material such as aluminum or vinyl, the tension produced from the interconnection of the channel with the gutter lip and the abutment rib with the edge of the roof boards causes the body to resiliently arch or bow. This tension holds the guard screen in place.

15 Claims, 1 Drawing Sheet

GUARD SCREEN FOR A RAIN GUTTER

BACKGROUND OF THE INVENTION

1. Field of the Invention

The present invention relates to guard screens for rain gutters, and more particularly relates to such screens being held in place by the tension created from the screen being fitted between the front lip of a gutter and the roof edge of a roof.

II. Description of the Prior Art

There are a number of previously known guard screens for rain gutters. The most typical of these screens comprises an elongated grill piece held in place over a gutter by clips which connect the grill to the gutter. While tending to keep some debris out of the gutter, the clipped-on grills often warp or manage to become disconnected or otherwise nonfunctional.

As an improvement over the typical guard screens, longitudinal fasteners have occasionally been added to the guard screen body to improve the screen's attachment to a gutter. Such fasteners conventionally comprise a front ridge of a type for interconnecting with the front lip of a gutter and a back ridge for fastening to the back flange of a gutter or to the fascia board of an eave.

However, this latter construction is difficult to apply because the back ridge must be attached to the gutter or fascia board by nails, screws or staples. In addition to this high level of attachment difficulty, because of capillary action, rain water tends to fall from the shingles and follow down along the fascia board behind the gutter on its way to doing some water damage to the wood below.

Accordingly, prior inventions have failed to eliminate the problems commonly associated with known guard screens for gutters.

SUMMARY OF THE PRESENT INVENTION

The present invention provides a guard screen for placement over the rain gutters of a building structure. The guard screen includes a longitudinal screen body portion bordered by a pair of longitudinal edges. The first edge has a channel defined therein for interconnection with the front lip of a gutter. The second edge includes a flange and a roof board edge abutment rib. The flange of the second edge fits between shingles of a roof and the roof boards. The roof board edge abutment rib abuts the roof board edge.

The screen body is preferably composed of a metal such as aluminum or a polymerized material such as vinyl. The longitudinal edges may also be composed of such materials. Either composition provides for that amount of resiliency necessary for locking the guard screen in place.

Locking is accomplished by first sliding the flange of the second edge between the shingles and the roof boards until the abutment rib abuts the roof board edge. The first, or channel, edge is then forced to interconnect with the front lip of the gutter. This application creates a tension in the body which causes the body to arch, or bax, thereby keeping the front lip locked into the channel edge.

The guard screen according to the present invention may be applied to either the standard "K-style" gutter or to half-round shaped gutters.

Other advantages and features of the present invention will become more apparent from the following detailed description when read in conjunction with the accompanying drawings.

BRIEF DESCRIPTION OF THE DRAWINGS

The present invention will be more fully understood by reference to the following detailed description of the preferred embodiment of the present invention when read in conjunction with the accompanying drawing, in which like reference characters refer to like parts throughout the views, and in which.

Detailed Description of the Preferred Embodiment of the Present Invention

Figure 1:
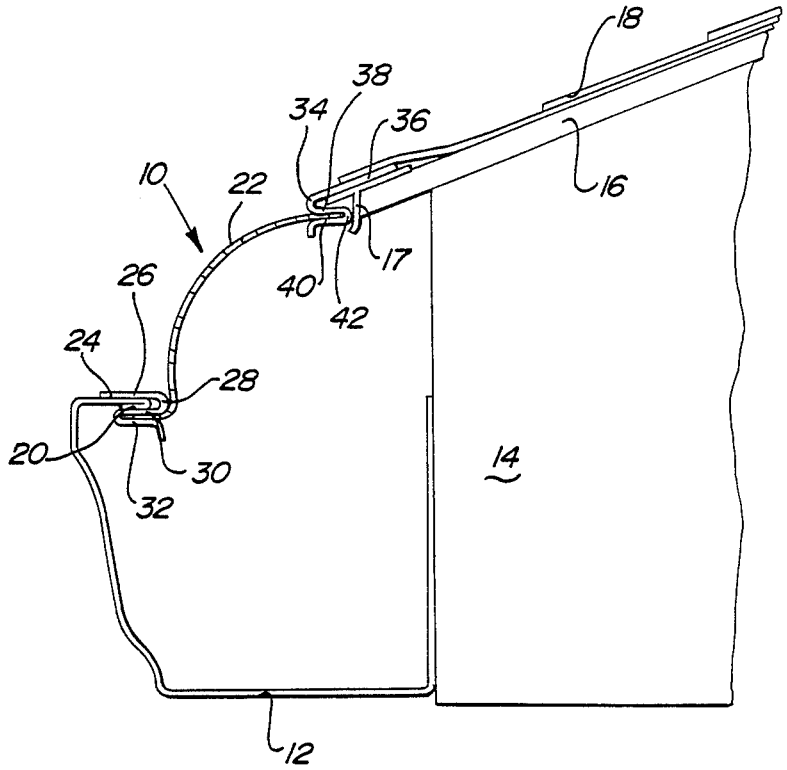
FIG. 1 is a cross-sectional view of a guard screen for a gutter according to the present invention in place on a gutter.
Figure 2:
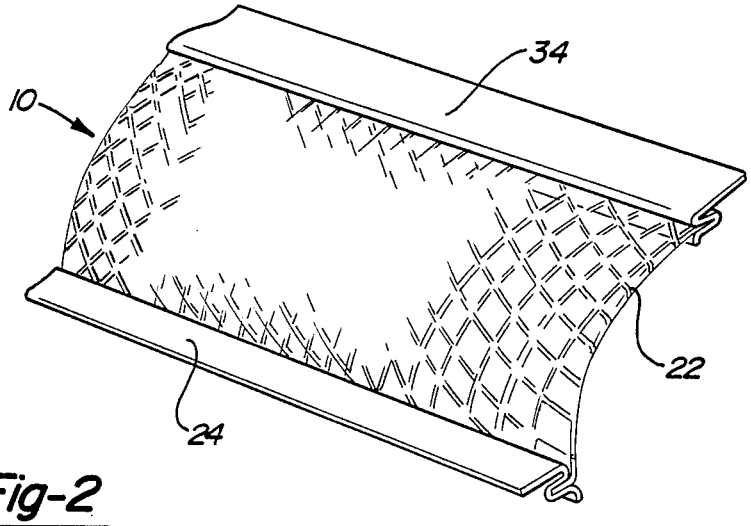
FIG. 2 is a partial perspective view of a guard screen according to the present invention.

FIGS. 1 and 2 show a preferred embodiment of the present invention. While the configuration according to the illustrated embodiment is preferred, it is envisioned that alternate configurations of the present invention may be adopted without deviating from the invention as portrayed. The preferred embodiment is discussed hereafter.

With reference to FIG. 1, there is shown a guard screen for a gutter according to the present invention, generally indicated as 10, in place over a gutter 12. The gutter 12 as shown is of the conventional "K-style" design, although the guard screen according to the present invention may be fitted to half-round shaped gutters (not shown) as well.

The gutter 12 is attached to a fascia board 14 of a building's eave. Atop the fascia board 14 is provided one or more roof boards 16 which have overlying thereover a plurality of roof shingles 18. At the front edge of the board 16 is conventionally fitted a drip edge or gutter edge 17. The drip edge or gutter edge 17 is composed normally of a plastic or nylon, and is fitted to the edge of the boards 16 before the shingles 18 are applied to protect the underlying wood and to prevent curling or sagging of the shingles 18. The gutter 12, the fascia board 14, the roof board 16, the drip edge or gutter edge 17 and the shingles 18 present a construction which is conventionally known. Also conventional is the fact that the gutter 12 also includes a front lip 20.

The guard screen 10 comprises three component parts. The first is a longitudinal screen body 22 (more clearly seen in FIG. 2) which is of such construction that water may bypass while debris is caught. The body 22 may be composed of a metal, preferably aluminum, or a polymerized material, such as vinyl. In any event, it is preferred that the body 22 be resiliently flexible for reasons discussed below.

Fitted to one edge (the "front" edge) of the body 22 is a lip-receiving elongated channel portion 24. The channel portion comprises a first horizontal member 26 connected in cantilevered relation to a vertical member 28. The vertical member 28 is connected to a second horizontal member 20. By the interconnection of the first horizontal member 26, the vertical member 28, and the second horizontal member 30, a lip-receiving channel 32 is formed for receiving the front lip 20 of the gutter 12.

Also connected to the second horizontal member 30 is a third horizontal member 32. The screen body 22 is crimped between the bottom side of the second horizontal member 30 and the top side of the third horizontal member 32.

Fitted to the other edge (the "back" edge) of the body 22 is a roof edge interconnecting flanged member 34. The flanged member 34 comprises a flange 36 connected in cantilevered relation to a first planar member 38. The first planar member is connected to a second planar member 40. The screen body 22 is crimped between the bottom side of the first planar member 38 and the top side of the second planar member 40.

The interconnection of the first planar member 38 with the second planar member 40 forms a roof edge abutment rib 42 thereby. The rib 42 is directed at abutting against a front edge 44 of the roof board 16.

To place the guard screen 10 in its intended position, the flange 36 is inserted between the shingles 18 and the roof board 16. The flange 36 is pushed therebetween until the abutment rib 42 abuts the drip edge or the gutter edge 17 on the roof board 16, whereupon the inserting motion halts.

Thereafter, the channel portion 24 is depressed causing the screen body 22 to arch or bow slightly because of its resilient character. The channel portion 24 is then aligned with the front lip 20 of the gutter 12 and is fitted to the lip 20 so that the channel of the channeled portion 24 fits thereover. The tension created by the abutment of the flanged member 34 against the drip edge or the gutter edge 17 and the resiliency of the body 22 keep the channeled member 24 in place against the lip 20. As illustrated in FIG. 1, an arch or bow is formed in the body 22 by the tension created according to this fastening method, thus rendering conventional fasteners unnecessary.

In addition to this advantageous method of fastenerless attachment, the flange 36, being positioned below the shingles 18 as discussed, prevents water from traveling, by means of capillary action, along the front board 16 and the fascia board 14 to bypass the gutter 12 by passing therebehind. By the flange 36 more accurately directing the water into the gutter 12, contact of water with rot-susceptible wood is prevented.

I claim:

1. In combination with roof boards of a roof having shingles laid thereover and a longitudinally extending rain gutter having a front lip, a guard screen interconnecting said boards and said gutter, said screen comprising:

an elongated screen body;

an elongated channel interconnected with said screen body extending longitudinally of said screen body;

an elongated flanged member interconnected with said screen body and extending longitudinally of said screen body, said flanged member including a flange;

said channel being interconnectable with said lip of said gutter;

said flange being disposable between said shingles and said roof boards;

said roof boards including a roof edge;

said flanged member including a roof board edge abutment rib;

said roof board edge abutment rib being abuttable against said front edge of said roof boards;

said screen body being composed of sufficiently resilient material whereby tension produced from the interconnection of said channel with said lip and said abutment rib with said front edge of said roof boards causes said body to resiliently arch.

2. A guard screen according to claim 1 wherein said body is composed of a metal.

3. A guard screen according to claim 2 wherein said metal is aluminum.

4. A guard screen according to claim 1 wherein said body is composed of a polymerized material.

5. A guard screen according to claim 1 wherein said body has a first edge and a second edge.

6. A guard screen according to claim 5 wherein said elongated channel comprises, in cross-section:

a vertical member having an upper edge and a lower edge;

a first horizontal member connected in cantilevered relation to said upper edge of said vertical member;

a second horizontal member having a top side and a bottom side and a first edge and a second edge, said second edge of said second horizontal member being connected in cantilevered relation to said lower edge of said vertical member;

said first and second horizontal members and said vertical member forming a gutter lip receiving channel therein;

a third horizontal member having a top side and a bottom side and a first edge and a second edge, said first edge of said third horizontal member being interconnected with said first edge of said second horizontal member; and said first edge of said screen body being clamped between said bottom side of said second horizontal member and said top side of said third horizontal member.

7. A guard screen according to claim 5 wherein said elongated flanged member comprises, in cross section:

a first planar member having a top side and a bottom side and a first edge and a second edge, said first edge being interconnected with said flange;

a second planar member having a top side and a bottom side and a first edge and a second edge, said second edge of said second planar member being interconnected with said second edge of said first planar member;

said roof board edge abutment rib being formed by said interconnection of said second edge of said second planar member with said second edge of said first planar member; and said second edge of said screen body being clamped between said bottom side of said first planar member and said top side of said second planar member.

8. A guard screen in combination with a rain gutter fittable between the front lip of a gutter and the front edge of roof boards of a building's roof having shingles laid thereover, said guard screen comprising:

a resilient elongated screen body;

said screen body being positionable in an arched engaged position in said gutter;

said screen body having a substantially planar profile when disengaged from said gutter and unstresed;

said screen body being continuously urged to said planar profile by said resiliency;

an elongated channel interconnected with said screen body extending longitudinally of said screen body;

an elongated flanged member interconnected with said screen body and extending longitudinally of said screen body, said flanged member including a flange and a roof board edge abutment rib;

said flange being disposable between said shingles and said roof boards;

said roof board edge abutment rib being abuttable against said front edge of said roof boards;

said body being of sufficiently resilient material whereby tension produced from the interconnection of said channel with said lip and said abutment rib with said front edge of said roof boards causes said body to resilient arch in its arched engaged position.

9. A guard screen according to claim 8 wherein said screen body is composed of aluminum.

10. A guard screen according to claim 8 wherein said screen body is composed of a polymerized material.

11. A guard screen in combination with a rain gutter fittable between the front lip of a gutter and the front edge of roof boards of a building's roof having shingles laid thereover, said guard screen comprising:

a resilient protective body portion positionable in an arched engaged position in said gutter;

a front portion fixed to said body portion and interconnectable with said front lip of said gutter; and a back portion fixed to said body portion and partially interfittable between said shingles and said roof boards;

said body portion including a roof board edge abutment lip;

said roof board edge abutment rib being abuttable against said front edge of said roof boards; and said screen being composed of sufficiently resilient material whereby tension produced from the interconnection of said front portion with said lip and said abutment rib with said front edge of said roof boards causes said body to resilient arch;

said screen body having a substantially planar profile when disengaged from said gutter and unstressed;

said screen body being continuously urged to said planar profile by said resiliency.

12. A guard screen according to claim 11 wherein:

said body portion is a longitudinal screen having a first edge and a second edge;

said front portion comprises an elongated channel; and said back portion comprises an elongated flanged member.

13. A guard screen according to claim 12 wherein said elongated channel comprises, in cross-section:

a vertical member having an upper edge and a lower edge;

a first horizontal member connected in cantilevered relation to said upper edge of said vertical member;

a second horizontal member having a top side and a bottom side and a first edge and a second edge, said second edge of said second horizontal member being connected in cantilevered relation to said lower edge of said vertical member;

said first and second horizontal members and said vertical member forming a gutter lip receiving channel therein;

a third horizontal member having a top side and a bottom side and a first edge and a second edge, said first edge of said third horizontal member being interconnected with said first edge of said second horizontal member; and said first edge of said screen body being clamped between said bottom side of said second horizontal member and said top side of said third horizontal member.

14. A guard screen according to claim 12 wherein said elongated flanged member comprises, in cross-section:

a first planar member having a top side and a bottom side and a first edge and a second edge, said first edge being interconnected with said flange;

a second planar member having a top side and a bottom side and a first edge and a second edge, said second edge of said second planar member being interconnected with said second edge of said first planar member; said roof board edge abutment rib being formed by said interconnection of said second edge of said second planar member with said second edge of said first planar member; and said second edge of said screen body being clamped between said bottom side of said first planar member and said top side of said second planar member.

15. In combination with roof boards of a roof having shingles laid thereof and a longitudinally extending rain gutter having a front lip, a guard screen interconnecting said boards and said gutter, said screening comprising:

an elongated screen body having a first edge and a second edge;

an elongated channel interconnected with said screen body extending longitudinally of said screen body;

an elongated flange*d member interconnected with said screen body and extending longitudinally of said screen body, said flanged member including a flange and a roof board abutment rib;

said channel being interconnectable with said lip of said gutter;

said flange being disposable between said shingles and said roof boards; and said elongated flange member comprising, in cross section:

a first planar member having a top side and a bottom side and a first edge and a second edge, said first edge being interconnected with said flange;

a second planar member having a top side and a bottom side and a first edge and a second edge, said second edge of said second planar member being interconnected with said second edge of said first planar member;

said roof board edge abutment rib being formed by said interconnection of said second edge of said second planar member with said second edge of said first planar member; and said second edge of said screen body being clamped between said bottom side of said first planar member and said top side of said second planar member.

* * * * *